US006100851A

United States Patent [19]

Jones

[11] Patent Number: 6,100,851

[45] Date of Patent: Aug. 8, 2000

[54] SATELLITE ANTENNA HEATING SYSTEM

[75] Inventor: Thaddeus M. Jones, Bremen, Ind.

[73] Assignee: MSX, Inc., South Bend, Ind.

[21] Appl. No.: 09/251,593

[22] Filed: Feb. 17, 1999

Related U.S. Application Data

[63] Continuation-in-part of application No. 09/019,268, Feb. 5, 1998.

[51] Int. Cl.[7] ..... H01Q 1/02

[52] U.S. Cl. ..... 343/704; 343/703; 343/840

[58] Field of Search ..... 343/703, 704, 343/840; H01Q 1/02

[56] References Cited

U.S. PATENT DOCUMENTS 5,861,855 1/1999 Arsenault et al. ..... 343/704

*Primary Examiner*—Don Wong
*Assistant Examiner*—Shih-Chuo Chen
*Attorney, Agent, or Firm*—Taylor & Aust, P.C.

[57] ABSTRACT

A heated antenna system includes an antenna having a reflecting surface and a heater associated with the reflecting surface. The heater has a current and at least one voltage. An electrical control system is electrically coupled to the heater of the antenna. The electrical control system is configured for monitoring at least one of the current and the at least one voltage of the heater and issuing a status signal indicative of a status of the heater. A conductor is configured for simultaneously carrying electrical energy to the electrical control system and carrying data and electrical energy to the antenna. The electrical energy provides the current and the at least one voltage to thereby power the heater.

10 Claims, 4 Drawing Sheets

SATELLITE ANTENNA HEATING SYSTEM

CROSS REFERENCE TO RELATED APPLICATION

This is a continuation-in-part of U.S. patent application Ser. No. 09/019,268 filed Feb. 5, 1998.

BACKGROUND OF THE INVENTION

1. Field of the Invention

The present invention relates to reflectors in satellite systems, and, more particularly, heating systems for reflectors in satellite systems.

2. Description of the Related Art

An antenna reflector, commonly called a dish, is generally a parabolic section having a round, elliptical or other configuration. A reflector functions to gather radio or microwave frequency energy transmitted from the feed horn or through the ambient environment from an external transmitter. The reflector can thus be used to receive and transmit signals to and from the satellite system. Typical applications include communicating data collected by a point of sale terminal in a store to the central data processing location. In this way, a large company can keep track of its sales and inventory requirements on an instantaneous basis. Maintaining a reliable satellite contact is absolutely essential. Reflectors are usually located outdoors, where snow and ice may collect on the receiving or concave side, degrading the performance of the reflector. If the link fails, store clerks have no way of executing any transactions with a customer. Thus, outages caused by snow and ice accumulation on the antenna reflector and feed are intolerable. In view of this, it is known to install heating apparatuses for deicing antennas in climates where snow and ice can present problems.

An antenna for the satellite terminal is often installed on the roof of the structure. Power line voltage is wired to the antenna for deicing purposes. Such power line voltage must be carried in a conduit on the outside of the building, or fed through an opening in the roof. Because of the distance between the power supply inside the building and the rooftop antenna, a relatively long piece of conduit is necessary. A problem is that the length of the conduit, coupled with the twisting, exposed path that the conduit must often take, subjects the conduit to being severed, shorted, or pulled loose from its connection due to its own weight. If the electrical connection between the conduit and the antenna is lost because of any of the above problems, the heater will not operate, snow and ice may collect on the reflector, and the performance of the reflector will be degraded.

It is also known to provide separate transmission lines to carry power to the antenna heater and to carry data between a terminal and the antenna. Such data and power lines are expensive, however, and each line is subject to breakage or shorting.

What is needed in the art is a heating system for a reflector which can, while minimizing the hardware needed to carry power and data to the reflector, sense a loss-of heater power and inform a user of the loss.

SUMMARY OF THE INVENTION

The present invention provides a heating system for a satellite reflector which monitors the heater for the presence of heater voltage, issues a status signal indicative thereof, and carries both heater power and transmission data on the same conductor.

The invention comprises, in one form thereof, a heated antenna system including an antenna having a reflecting surface and a heater associated with the reflecting surface. The heater has a current and at least one voltage. An electrical control system is electrically coupled to the heater of the antenna. The electrical control system is configured for monitoring at least one of the current and the at least one voltage of the heater and issuing a status signal indicative of a status of the heater. A conductor is configured for simultaneously carrying electrical energy to the electrical control system and carrying data and electrical energy to the antenna. The electrical energy provides the current and the at least one voltage to thereby power the heater.

An advantage of the present invention is that a single conductor is used to both carry data to the antenna and carry electrical energy to the heater.

Another advantage is that if the heater is not functioning properly, an alarm signal is transmitted to a receiver at a location of the user's choice. Thus, the user is informed when maintenance and/or repair of the heating system is required.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
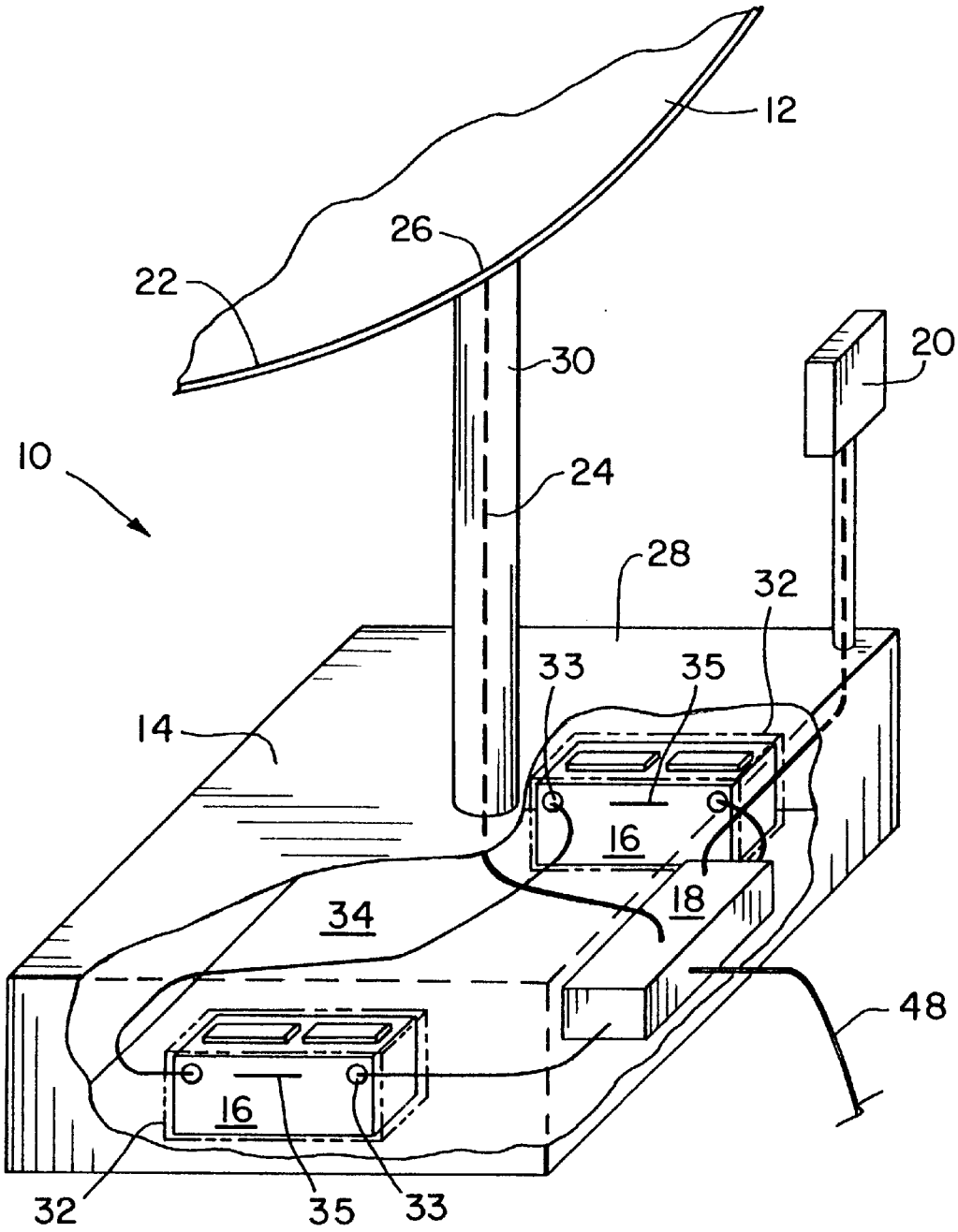
FIG. 1 is a simplified perspective view of one embodiment of a heated antenna system of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a heated antenna system 10 including a reflector 12, a container 14, batteries 16, electronics 18 and sensors 20.

Unless otherwise noted, details familiar to persons skilled in the electronic arts will be omitted since they are extraneous detail and thus have no bearing on reducing the invention to practice. Where in this application the terms "control", "controlling" or the like are used, it is to be understood that such terms may include the meaning of the terms "regulate", "regulating", etc. That is, such "control" may or may not include a feedback loop. Moreover, it is also to be understood, and it will be appreciated by those skilled in the art, that the methodology and logic of the present invention described herein may be carried out using any number of structural configurations such as electronic hardware, software, and/or firmware, or the like.

Reflector 12 includes a reflecting surface 22 having a desired curvature for the specific application for which reflector 12 is to be utilized. Reflecting surface 22 transmits radio or microwave frequency energy carried by a cable assembly 24. Reflecting surface 22 can also reflect such energy transmitted from an external source (not shown).

Reflector 12 also includes a heater 26 for melting accumulated ice and snow on reflecting surface 22. Heater 26, in the embodiment shown, is in the form of a zig-zagging resistance wire which is electrically connected to and powered by cable assembly 24. However, other types of heaters may be used. Cable assembly 24 includes a coaxial cable associated with a feedhorn (not shown), as well as at least one power line which carries current to heater 26.

Container 14 is shown in the form of a box which contains and somewhat loosely encloses batteries 16 and electronics 18. Alternatively, container 14 can be made substantially watertight so as to prevent outside moisture from damaging batteries 16 and electronics 18, and also to prevent any leakage from batteries 16 from coming in contact with the outside environment. Container 14 also carries sensors 20 on an outside surface 28. A pedestal 30 which supports reflector 12 is held upright in container 14 and extends therefrom, interconnecting container 14 and reflector 12. Container 14 holds pedestal 30 in position so that reflector 12 is maintained at a desired angle. Container 14, weighted down by batteries 16, also functions as a ballast for reflector 12.

Batteries 16 are in the form of two 12 volt direct current batteries that are series-connected to provide a maximum 24 volts to heater 26. Together, batteries 16 form a direct-current voltage supply having a low voltage, herein meaning less than or equal to approximately 120 volts. Each 12 volt battery 16 includes a number of low voltage cells, each of which contributes perhaps 1.5 volts to the 12 volt total. Each 12 volt battery 16 is encased in a battery box 32 (shown in phantom lines to allow visualization of batteries 16) having a substantially leak-proof bottom which prevents any acid leakage from a battery 16 from entering into container 14. Battery box 32 is in the form of a substantially detachable shipping container or protection container. Battery box 32 includes terminals 33 which are electrically connected to the terminals (not shown) of battery 16. Terminals 33 allow batteries 16 to be wired without having to remove them from battery boxes 32. Battery box 32 includes vents 35 which allow the release of gasses, also known as outgassing, from battery 16. Batteries 16 are shown as being disposed on a bottom surface 34 of container 14, but may be placed at any desired location (e.g., under and attached to container 14). Batteries 16 have a weight which is sufficient to function as a ballast for reflector 12.

Figure 2:
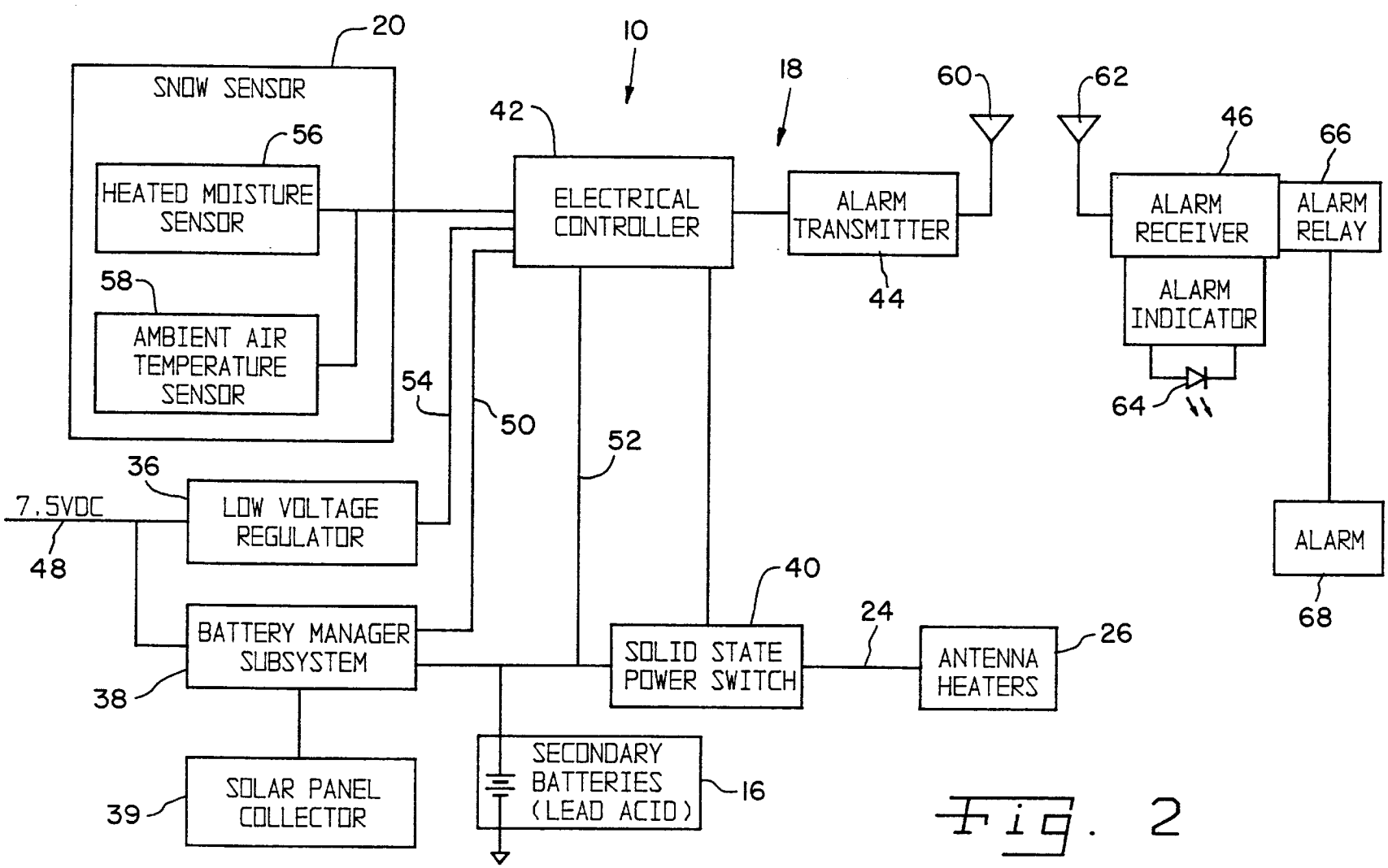
FIG. 2 is a schematic, block diagram of the heated antenna system of FIG. 1.

Referring now to FIG. 2, electronics 18 includes a low voltage regulator 36, a battery manager subsystem 38, a solar collector 39, a solid state power switch 40, an electrical controller 42 and an alarm transmitter 44. Battery manager subsystem 38 and electrical controller 42 together form an electrical control system, or monitoring device, which monitors the voltage of batteries 16 and recharges batteries 16 in order to maintain the voltage within a predetermined range.

Coaxial cable 48 carries both data and a relatively low direct current (DC) voltage offset, for example 7.5 volts, to electronics 18. The data is passed on, substantially unaltered, to reflector 12 by electronics 18. Electronics 18 uses the 7.5 volt direct-current offset to both power electronics 18 and to recharge batteries 16 through battery manager subsystem 38. Low voltage regulator 36 uses the DC voltage carried on coaxial cable 48 to provide a direct current power input, typically 5 volts, to electrical controller 42.

Battery manager subsystem 38 includes a DC-to-DC converter which steps up the 7.5 VDC offset carried on coaxial cable 48 to a desired DC voltage level, e.g., 24 volts DC, in order to recharge the two series-connected 12 volt batteries;16. In addition to charging batteries 16, battery manager subsystem 38 also monitors the present voltage level of batteries 16 in order to maintain the voltage within a predetermined range. It is well known that allowing the voltage of such lead-acid batteries to fall below a certain level, a condition also known as "deep discharge", can result in the failure of the battery. Destructive plating can occur as a result of the deep discharge, in which case the battery would have to be replaced. Conversely, overcharging lead-acid batteries can also result in damage to the batteries, as overcharging may lead to hot gassing in the form of a release of hydrogen gas.

Because of the criticality of maintaining batteries 16 within the predetermined voltage range, battery manager subsystem 38 recharges batteries 16 using a low current trickle charge. When the voltage of batteries 16 is below a certain threshold voltage, however, battery manager subsystem 38 is capable of recharging batteries 16 at a faster rate than that of the trickle charging mode. The threshold value may be above or below the lower limit of the predetermined voltage range in which batteries 16 are to be maintained. The voltage and the current of the trickle charge can be made dependent upon the ambient temperature, which temperature may be ascertained by sensors 20, as described in more detail hereinafter. It may be desirable to have a relatively high rate of charge at lower temperatures, where the heating needs of reflector 12 are greater, and consequently, so are the power needs.

In addition to recharging batteries 16, battery manager subsystem 38 also sends signals over line 50 to electrical controller 42. The signal indicates whether the present voltage level of batteries 16 is within the acceptable range.

Taking advantage of the rooftop location of reflector 12, a solar collector 39 can be connected to battery manager subsystem 38 in order to supplement the power supplied by the 7.5 volt DC input signal. Solar collector 39 reduces the power consumption and thus the overall cost of operating heated antenna system 10.

Electrical controller 42 is powered by the low voltage output of low voltage regulator 36 on line 54. The voltage of batteries 16 is also made available to electrical controller 42 over line 52 so that electrical controller 42 can use the battery voltage to power sensors 20. Electrical controller 42 can also be used to control the charging function of battery manager subsystem 38.

Sensors 20 are connected by a pole to outside surface 28 of container 14 such that a moisture sensor 56 can detect precipitation, such as rain or snow, and a temperature sensor 58 can measure the temperature of the outside environment. The height of the pole positions sensors 20 at a level where sensors 20 will not become buried by debris or previously fallen snow, and sensors 20 will not be warmed by the rooftop. Based upon information received from sensors 56 and 58, electrical controller 42 opens or closes solid state power switch 40, which electrically interconnects batteries 16 and heater 26. If moisture sensor 56 indicates that precipitation is present, and temperature sensor 58 indicates that the ambient air temperature is within a predetermined range, for instance, between 17° F. and 38° F., electrical controller 42 closes power switch 40. Current then flows from batteries 16 and through the resistance wire of heater 26, thereby heating heater 26 and reflector 12.

It is desirable for more power to be provided to heater 26 at the lower end of the predetermined temperature range, where more heat is required to melt the ice or snow on reflector 12, than at the upper end of the predetermined temperature range. Using the minimum amount of power necessary to melt the ice and snow prolongs the life of batteries 16 and thereby reduces the overall expense of operating heated antenna system 10. At ambient temperatures above 17° F., electrical controller 42 periodically opens and closes power switch 40 in order to reduce the time averaged voltage and current supplied by batteries 16 to heater 26. Thus, power switch 40 continually cycles between being opened and closed, with the percent of time power switch 40 is open increasing with temperature up to 38° F., whereat power switch 40 remains open. Thus, electrical controller 42 pulse width modulates the voltage and current supplied to heater 26 by batteries 16, thereby adjusting the average or effective voltage and current supplied.

In the event that batteries 16 cannot be maintained in the desired voltage range, perhaps because of the absence of the 7.5 volt DC input, the user is notified that the heated antenna system needs attention in the form of maintenance or repairs. Upon receiving a status signal from battery manager subsystem 38 on line 50 indicating that the 7.5 volt DC input voltage is present and batteries 16 are within the desired voltage range, electrical controller 42 periodically transmits a status signal to alarm transmitter 44. Upon receiving the status signal, alarm transmitter 44 transmits a corresponding status signal from antenna 60. The status signal, as transmitted from antenna 60, is airborne and can be, e.g., of radio frequency. The status signal from alarm transmitter 44 is received by the antenna 62 of an alarm receiver 46, which can be disposed at a location convenient to the user. Upon receiving the status signal, alarm receiver 46 resets an internal clock. If after a predetermined amount of time, for instance 30 minutes, alarm receiver 46 has not received another status signal indicating that the desired voltages are present, alarm receiver 46 activates a light emitting diode (LED) 64, which the user can see and thereby be informed that the heated antenna system needs attention. It is also possible for alarm receiver 46 to activate an alarm relay 66, which, in turn, activates an audio alarm 68 to be heard by the user.

Of course, the heated antenna system of the present invention can have embodiments other than as shown. For instance, container 14 can have virtually any geometric shape and may even be a plate carrying and/or resting upon batteries 16. Also, batteries 16 may be other than lead-acid, such as, for example, a gel battery. Gel batteries have the advantages that they do not typically leak and substantially no maintenance is required. Moreover, batteries 16 may provide a voltage above or below 24 volts.

In yet another embodiment (not shown), another DC-to-DC converter electrically interconnects solid state power switch 40 and heater 26. The DC-to-DC converter steps up the voltage of batteries 16 to approximately the same level as that of a standard power line voltage outlet, i.e., approximately 120 volts. The increased voltage allows a smaller current to be sourced into heater 26 while maintaining the same power level. The smaller current allows the use of a correspondingly smaller gauge wire to carry the current to heater 26 and a smaller gauge resistance heater wire within heater 26. Thus, the DC-to-DC converter allows the use of a conventional heater and conventional wiring in conjunction with a direct current battery power supply.

It is also possible to include a DC-to-AC converter between solid state power switch 40 and heater 26, with or without the above-described DC-to-DC converter. The DC-to-DC and DC-to-AC converters, and similar devices, can be used to convert the voltage of batteries 16 into substantially any waveform that suits the particular needs of the heater being used.

The present invention can also be implemented in a heater which heats something other than a reflector. For example, the present invention can also be used in conjunction with a sub-reflector heater or a feed horn heater.

Figure 3:
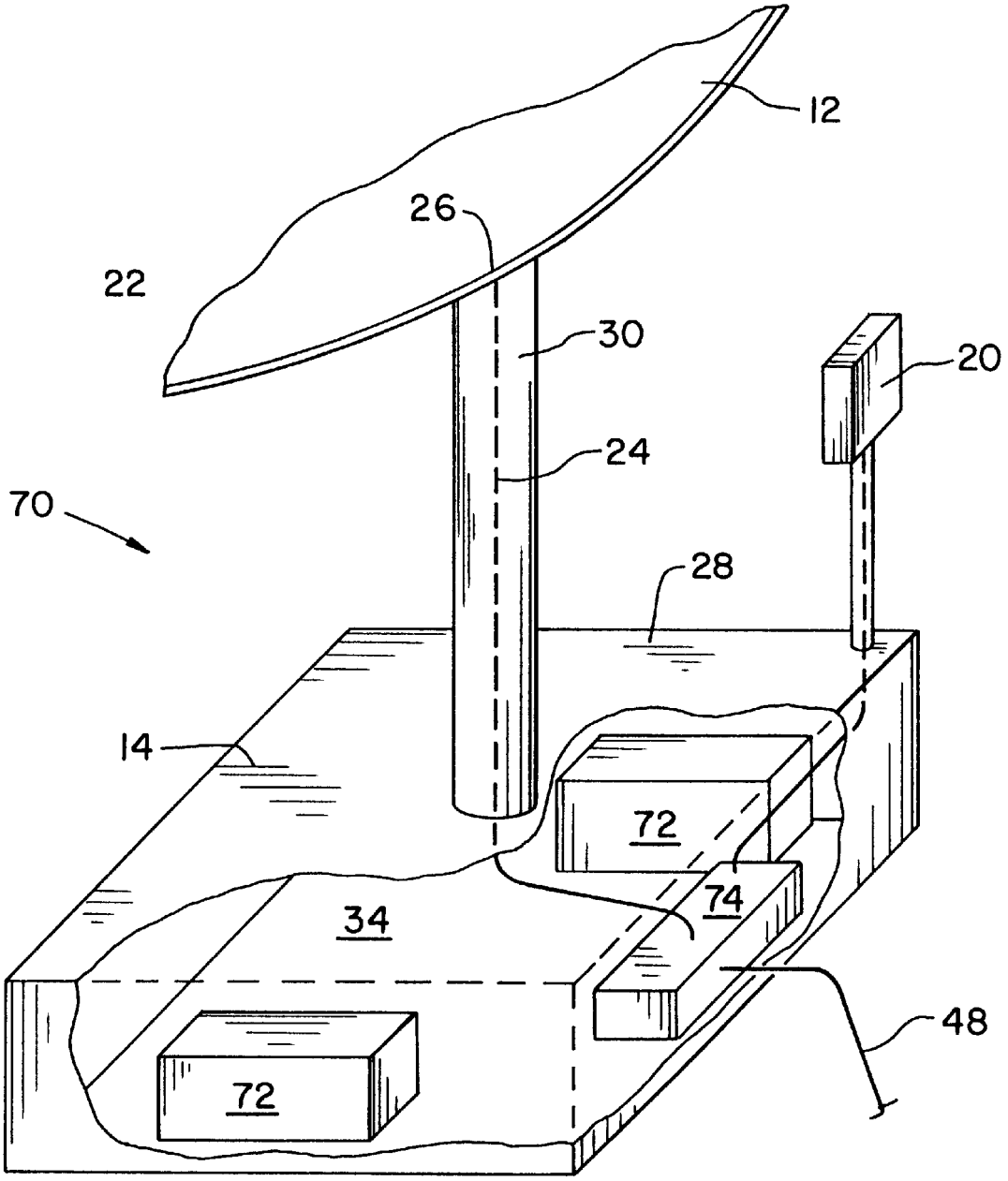
FIG. 3 is a simplified perspective view of another embodiment of a heated antenna system of the present invention.

In another embodiment of the present invention, shown in FIG. 3, a heated antenna system 70 includes ballasting blocks 72 in the place of batteries 16. Instead of using batteries to power heater 26, the electrical energy carried on coaxial cable 48 provides voltage and current to heater 26.

Figure 4:
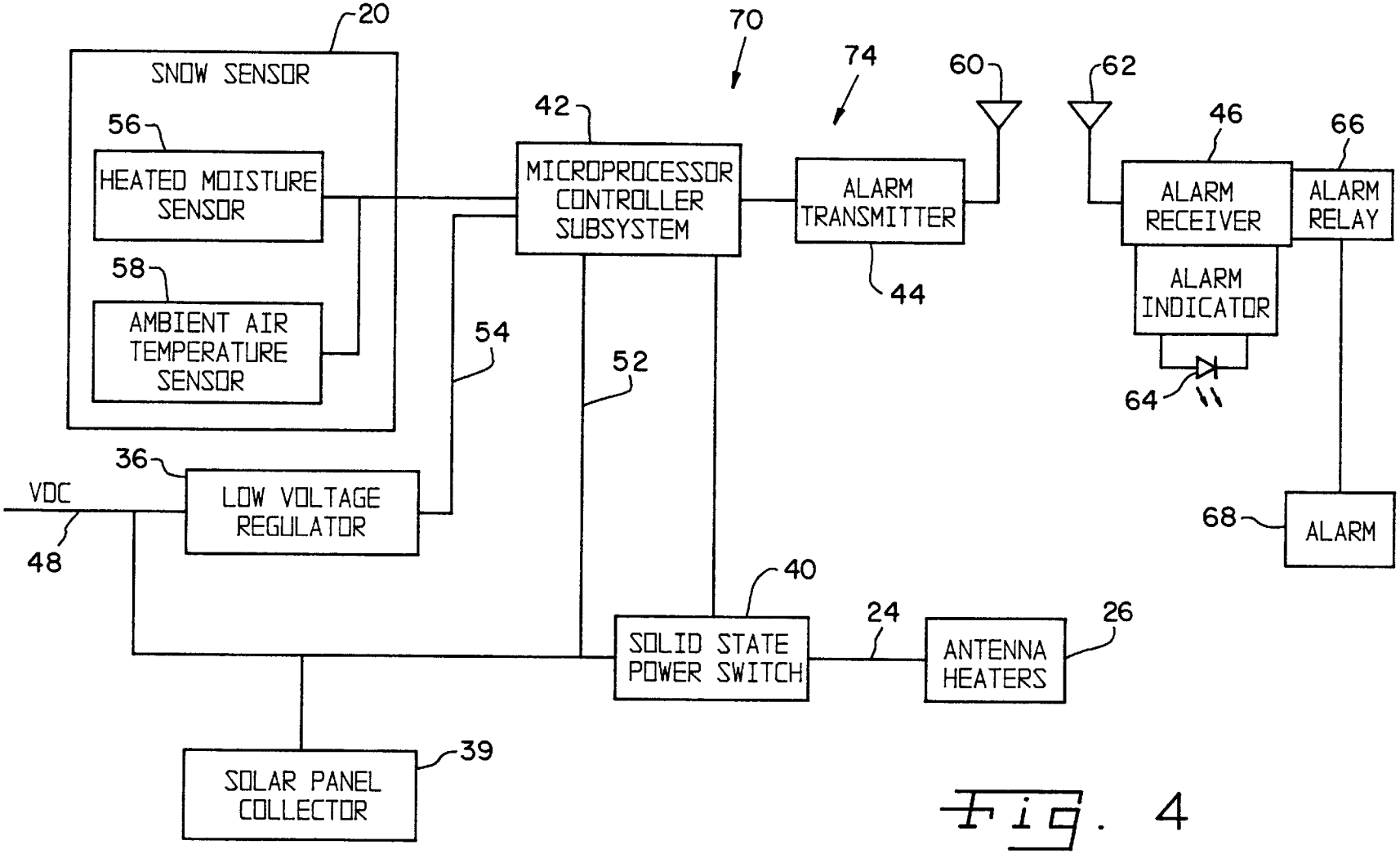
FIG. 4 is a schematic, block diagram of the heated antenna system of FIG. 3.

Referring now to FIG. 4, electronics 74 is substantially similar to electronics 18, except that battery manager subsystem 38 is eliminated. Coaxial cable 48 carries both data and a direct current (DC) voltage offset to electronics 74. The data is passed on, substantially unaltered, to reflector 12 by electronics 74. Electronics 74 uses the direct-current voltage offset to both power electronics 74 and to power heater 26.

The voltage level of the direct-current voltage offset can be set at substantially any level which meets the requirements of heater 26. For example, the direct-current voltage offset can be set approximately between 7.5 volts and 24 volts. Low voltage regulator 36 uses the DC voltage carried on coaxial cable 48 to provide a direct current power input, typically 5 volts, to electrical controller 42.

The higher the DC voltage offset, the smaller the current required to be sourced into heater 26 to maintain the same power level. The gauge of the wire in cable 48 carrying current to heater 26, and the gauge of the resistance heater wire within heater 26, can be selected based upon the power and current requirements of the particular application.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heated antenna system, comprising:

an antenna having a reflecting surface and a heater associated with said reflecting surface, said heater having a current and at least one voltage;

an electrical control system electrically coupled to said heater of said antenna, said electrical control system being configured for monitoring at least one of said current and said at least one voltage of said heater and issuing a status signal indicative of a status of said heater; and a conductor configured for simultaneously carrying electrical energy to said electrical control system and carrying data and electrical energy to said antenna, said electrical energy providing said current and said at least one voltage to thereby power said heater.

2. The heated antenna system of claim 1, wherein said status signal is indicative of a presence of said at least one voltage of said heater, said heated antenna system further comprising:

an alarm transmitter electrically connected with said electrical control system, said alarm transmitter being configured for receiving said status signal and transmitting an airborne signal, said airborne signal being dependent upon said status signal; and an alarm receiver configured for receiving said airborne signal and activating an alarm dependent upon said airborne signal.

3. The heated antenna system of claim 2, wherein said airborne signal comprises a radio frequency signal.

4. The heated antenna system of claim 1, wherein said at least one voltage comprises at least one direct current voltage.

5. The heated antenna system of claim 1, further comprising a power switch electrically interconnecting said conductor and said heater.

6. The heated antenna system of claim 5, wherein said electrical control system is electrically connected to said power switch, said electrical control system being configured to open and close said power switch such that said power switch transmits a pulse width modulated voltage to said heater, said pulse width modulated voltage being dependent upon an ambient temperature.

7. The heated antenna system of claim 1, wherein said at least one voltage of said heater is disabled outside of a predetermined range of ambient temperatures and has a variable effective voltage level within said predetermined range of ambient temperatures, said variable effective voltage level being dependent upon an ambient temperature.

8. The heated antenna system of claim 6, wherein said electrical control system is configured to continuously cyclically open and close said power switch when the ambient temperature is below a threshold temperature, a percentage of time that said power switch is open during said cycling varying with temperature.

9. The heated antenna system of claim 6, wherein said pulse width modulated voltage provides an effective voltage which varies substantially linearly with the ambient temperature.

10. The heated antenna system of claim 6, wherein said electrical control system is configured to cyclically open and close said power switch at a given constant ambient temperature.

* * * * *